US012588749B2

(12) United States Patent
Manassarians

(10) Patent No.: US 12,588,749 B2
(45) Date of Patent: Mar. 31, 2026

(54) POOL CLEANING DEVICE

(71) Applicant: Henrik Manassarians, Del Mar, CA (US)

(72) Inventor: Henrik Manassarians, Del Mar, CA (US)

( * ) Notice: Subject to any disclaimer, the term of this patent is extended or adjusted under 35 U.S.C. 154(b) by 333 days.

(21) Appl. No.: 18/237,957

(22) Filed: Aug. 25, 2023

(65) Prior Publication Data

US 2025/0064203 A1 Feb. 27, 2025

(51) Int. Cl.

| | |
|---|---|
| ***A46B 13/00*** | (2006.01) |
| ***A46B 7/08*** | (2006.01) |
| ***A46B 13/02*** | (2006.01) |
| ***E04H 4/16*** | (2006.01) |

(52) U.S. Cl.

CPC ..... *A46B 13/02* (2013.01); *A46B 7/08* (2013.01); *E04H 4/1618* (2013.01); *A46B 2200/3073* (2013.01)

(58) Field of Classification Search

CPC ... A46B 2200/3073; A46B 7/08; A46B 13/02; A46B 5/005; E04H 4/1618

USPC ..... 15/1

See application file for complete search history.

(56) References Cited

U.S. PATENT DOCUMENTS

| | | | | |
|---|---|---|---|---|
| 5,511,269 | A | 4/1996 | Watson | |
| 6,170,107 | B1 | 1/2001 | George | |
| 6,374,447 | B1 * | 4/2002 | Armbruster | B60S 3/048 15/97.1 |
| 9,681,782 | B2 | 6/2017 | McCauley | |
| D825,190 | S | 8/2018 | Hu | |
| 10,188,199 | B2 | 1/2019 | Hilliard | |
| 10,624,447 | B1 * | 4/2020 | Manning | A46B 13/001 |
| 11,154,909 | B2 * | 10/2021 | Brennan | A46B 13/001 |
| 11,420,235 | B2 | 8/2022 | Gibson | |

FOREIGN PATENT DOCUMENTS

| | | | |
|---|---|---|---|
| CA | 2515848 | 9/2004 | |
| WO | WO-2011044284 A1 * | 4/2011 | A46B 7/04 |

* cited by examiner

*Primary Examiner* — Katina N. Henson

(57) ABSTRACT

A pool cleaning device for cleaning pools includes a tubular wand having a brush portion and a battery portion. The tubular wand incudes a first shaft telescopically coupled within a second shaft. A battery housing is affixed to the battery portion and a power source is positioned within the battery housing. A motor housing is pivotably attached to the brush portion such that the motor housing is movable between an upwardly angled position and a downwardly angled position. A motor is positioned within the motor housing. An output shaft is rotatably coupled to the motor. The output shaft extends outwardly from the motor. A bristle brush is removably coupled to the output shaft, wherein the motor rotates the output shaft, thereby rotating the bristle brush. Pivoting the motor housing pivots the bristle brush between the upwardly angled position and the downwardly angled position.

7 Claims, 9 Drawing Sheets

POOL CLEANING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to scrubber brushes and more particularly pertains to a new scrubber brush for cleaning pools.

(2) Description of Related Art Including Information Disclosed Under 37 CFR 1.97 and 1.98

The prior art relates to scrubber brushes. Some prior art references disclose scrubber brushes with rotating brush heads and extendable handles. For example, some references disclose battery operated scrubber brushes with brush heads that can rotate or otherwise provide circular cleaning patterns. Other references disclose cleaning brushes that have handles that can be extended or shortened as desired, for example by using telescopic handle configurations. However, there is a need in the art for an electric scrubber brush having a rotating brush head and an extendable handle that can be used to efficiently clean a pool. There is also a need in the art for a scrubber brush that has interchangeable brush heads that can rotate and that can pivot around the handle so that the scrubber brush can effectively clean all corners and areas of the pool.

(h) BRIEF SUMMARY OF THE INVENTION

An embodiment of the disclosure meets the needs presented above by generally comprising a tubular wand having a brush portion and a battery portion. The tubular wand includes a first shaft telescopically coupled within a second shaft, such that the second shaft is extendable relative to the first shaft. A battery housing is affixed to the battery portion. The battery housing has an interior battery space and is configured to prevent penetration of water into the interior battery space. A power source is positioned within the interior battery space. A motor housing is pivotably attached to the brush portion such that the motor housing is movable between an upwardly angled position and a downwardly angled position. The motor housing also has an interior motor space and is configured to prevent penetration of water into the interior motor space. A motor is positioned in the interior motor space and is electronically coupled to the power source. An output shaft is rotatably coupled to the motor. The output shaft extends outwardly from the motor. A bristle brush is removably coupled to the output shaft, wherein the motor rotates the output shaft, thereby rotating the bristle brush. Pivoting the motor housing pivots the bristle brush between the upwardly angled position and the downwardly angled position.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
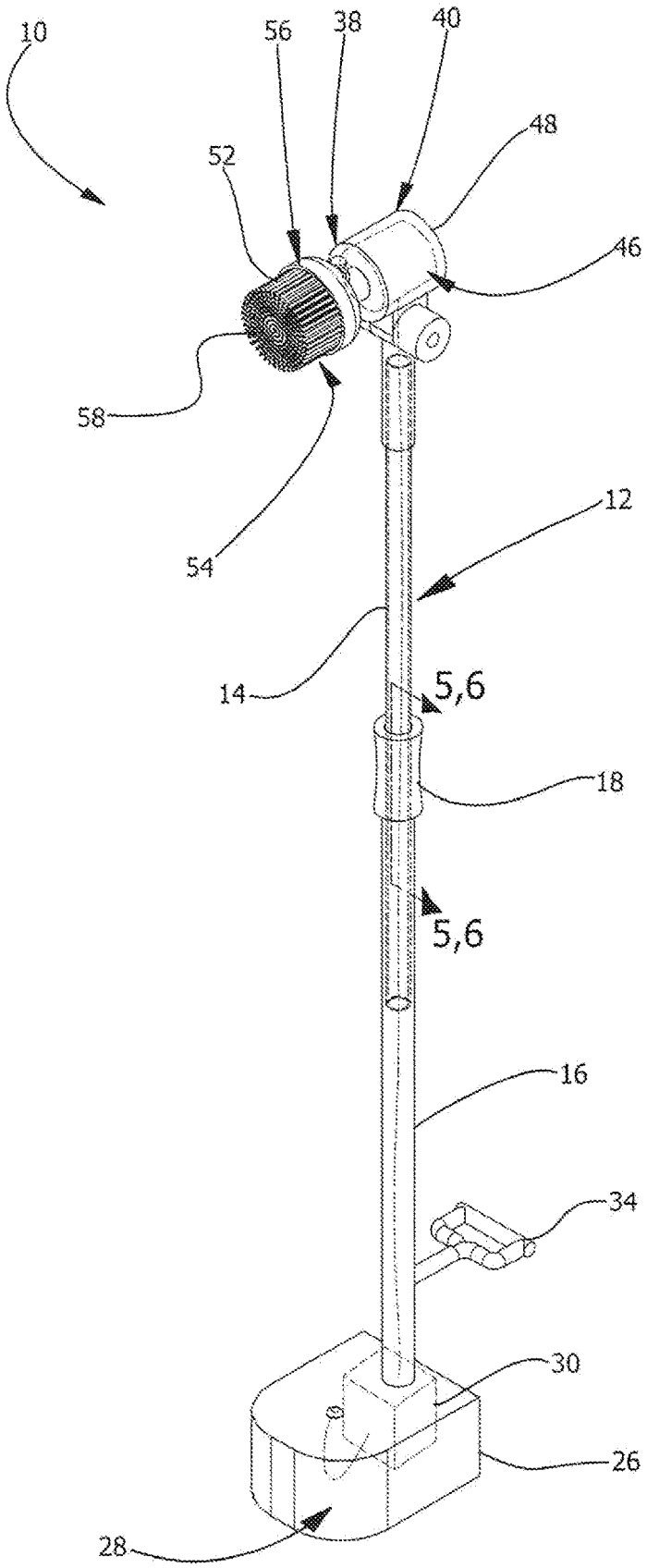
FIG. 1 is a top front isometric view of a pool cleaning device according to an embodiment of the disclosure.

With reference now to the drawings, and in particular to FIGS. 1 through 10 thereof, a new scrubber brush embodying the principles and concepts of an embodiment of the disclosure and generally designated by the reference numeral 10 will be described.

As best illustrated in FIGS. 1 through 10, the pool cleaning device 10 generally comprises a tubular wand 12 having a first shaft 14 telescopically coupled to a second shaft 16. The first shaft 14 is nested within the second shaft 16 such that the second shaft 16 is extendable relative to the first shaft 14.

An adjustment handle 18 is slidably coupled to the first shaft 14. The adjustment handle 18 is removably coupled to the second shaft 16. The adjustment handle 18 slides along the first shaft 14 when the adjustment handle 18 is removed from the second shaft 16. The adjustment handle 18 is configured to secure a position of the first shaft 14 relative to the second shaft 16 when the adjustment handle 18 is coupled to the second shaft 16.

A retaining flange 20 is integrally coupled to the second shaft 16 adjacent to the first shaft 14. The first shaft 14 is nested within the second shaft 16 adjacent to the retaining flange 20. The retaining flange 20 is resiliently compressible beneath the adjustment handle 18, wherein the adjustment handle 18 compresses the retaining flange 20, squeezing the retaining flange 20 over the first shaft 14, thereby restricting movement of the first shaft 14 relative to the second shaft 16.

In some embodiments, the adjustment handle 18 includes a handle threading 22 and the retaining flange 20 includes a flange threading 24. The handle threading 22 is complementary to the flange threading 24 such that the adjustment handle 18 is threadably coupled to the second shaft 16. Rotation of the adjustment handle 18 over the second shaft 16 is configured to compress the retaining flange 20, thereby bracing the first shaft 14 within the second shaft 16 and securing a length of the tubular wand 12.

A battery housing 26 is affixed to the tubular wand 12. For example, the battery housing 26 may be affixed to the second shaft 16 opposite the retaining flange 20. The battery housing 26 has an interior battery space 28. The battery housing 26 is configured to inhibit penetration of water into the interior battery space 28. For example, any openings on the battery housing 26 may be sealed to reduce or inhibit water flowing into the interior battery space 28. A power source 30 is positioned in the interior battery space 28. For example, the power source 30 may be a rechargeable battery. The battery housing 26 may be sufficiently sealed to minimize or eliminate the risk of water coming into contact with the power source 30. A charging port 32 may also be positioned on the battery housing 26. The charging port 32 is electronically coupled to the power source 30.

Figure 10:
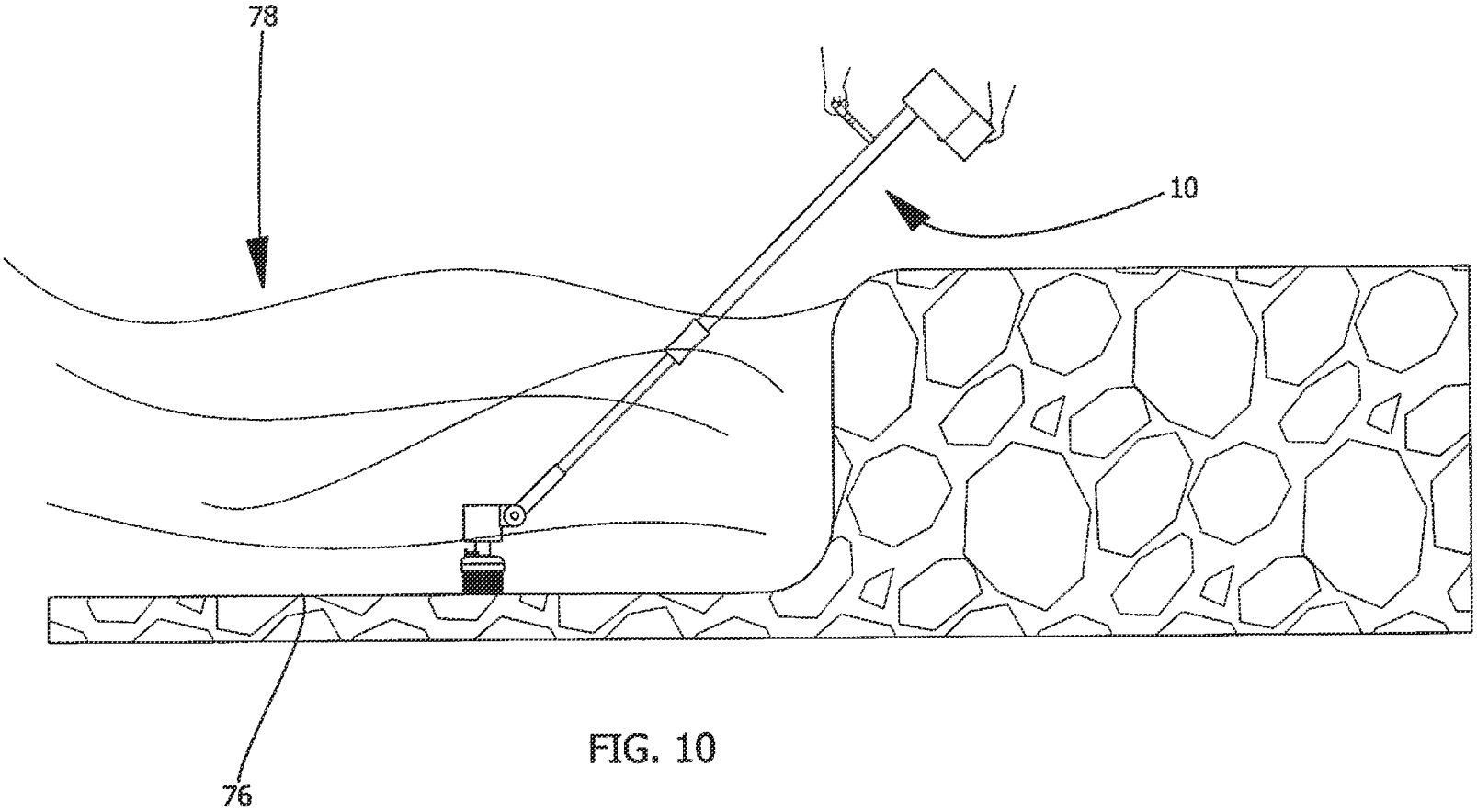
FIG. 10 is an in-use view of an embodiment of the disclosure.

A handle 34 may be affixed to the second shaft 16. For example, the handle 34 may be adjacent to the battery housing 26 and spaced from the adjustment handle 18. A user can hold the pool cleaning device 10 by the handle 34 when cleaning a pool. As shown in FIG. 10, a user can also guide the pool cleaning device 10 along a surface by gripping the battery housing 26 while applying downward pressure using the handle 34.

Figure 2:
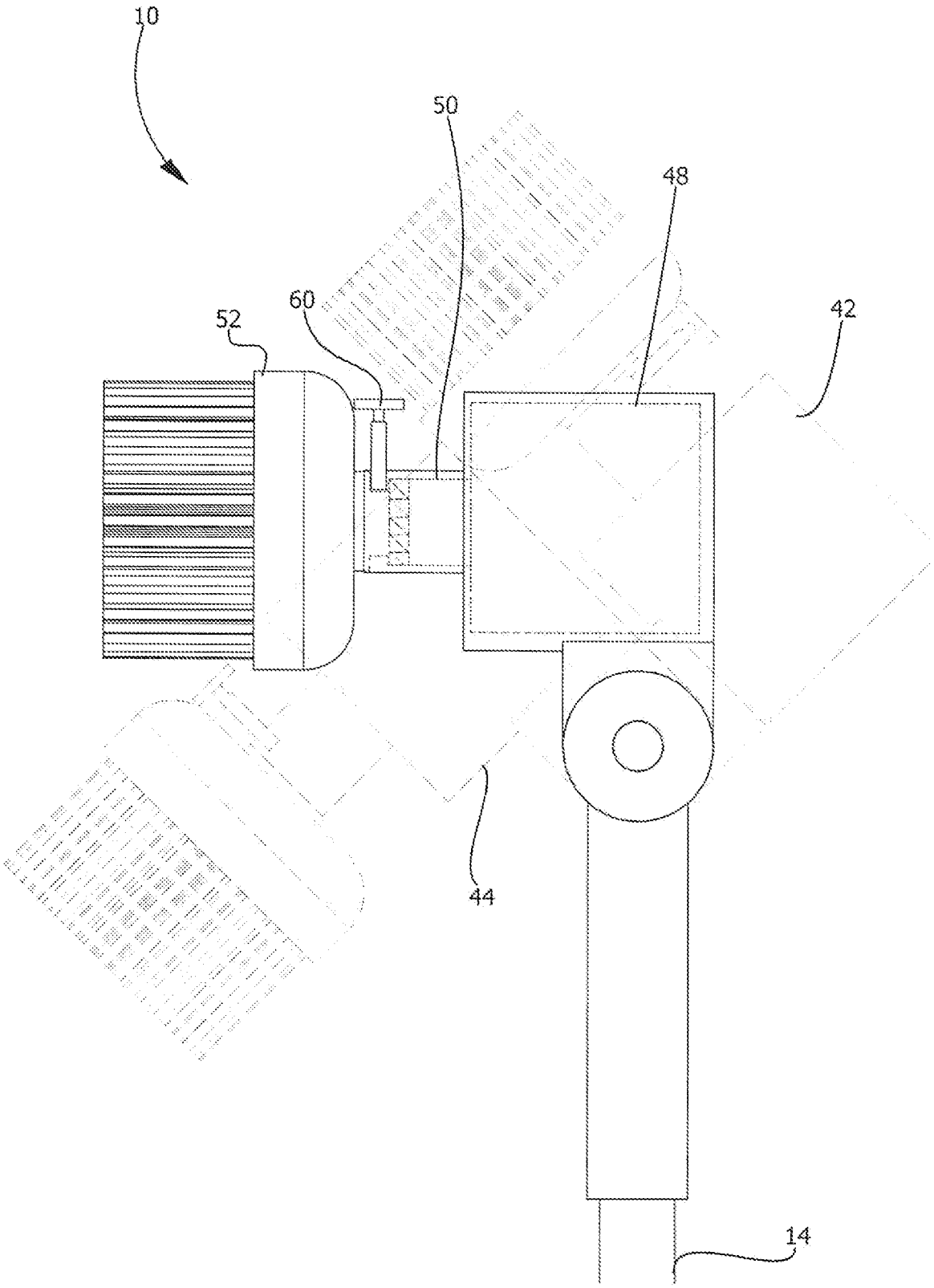
FIG. 2 is a side detailed view of an embodiment of the disclosure.
Figure 3:
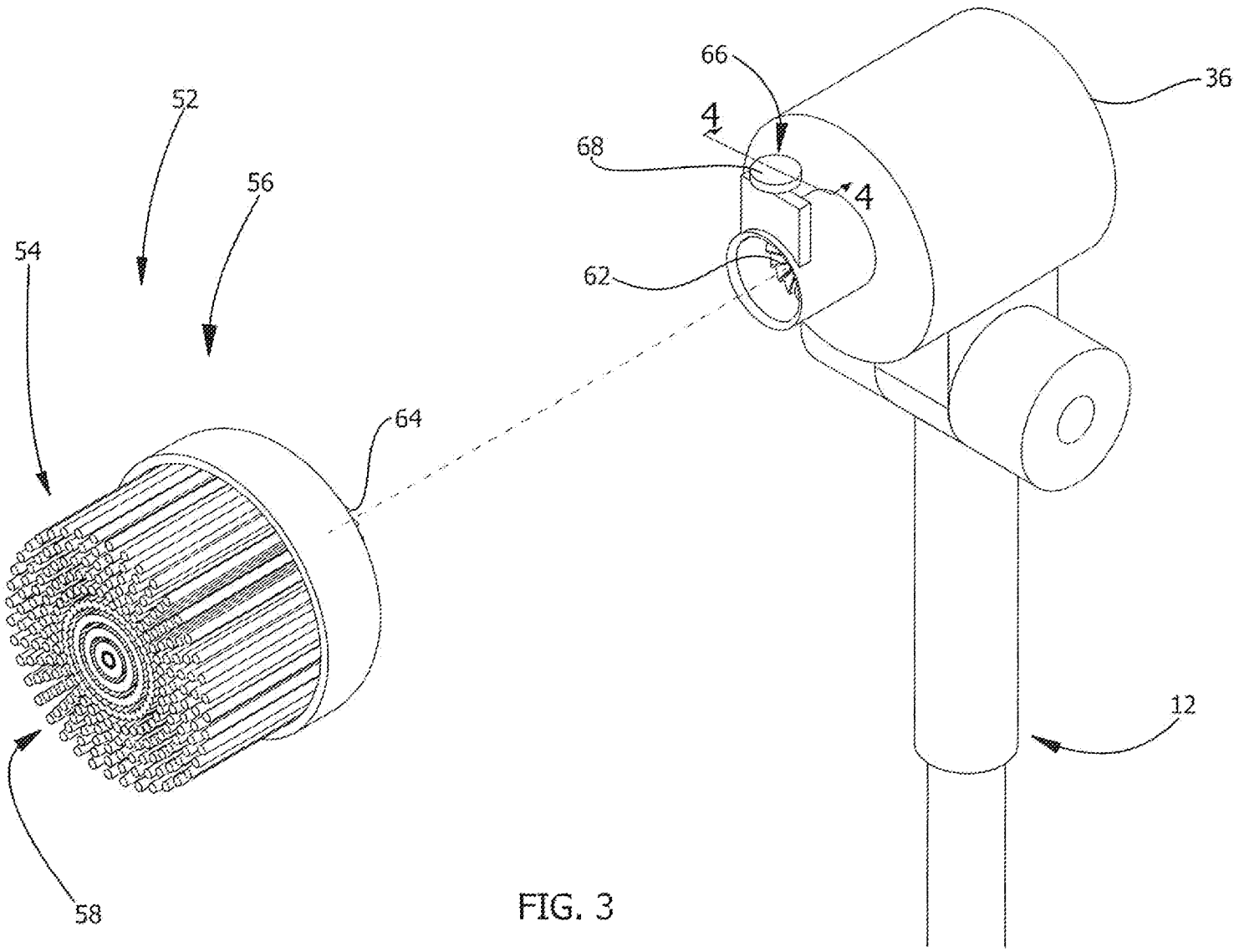
FIG. 3 is an exploded view of an embodiment of the disclosure.
Figure 4:
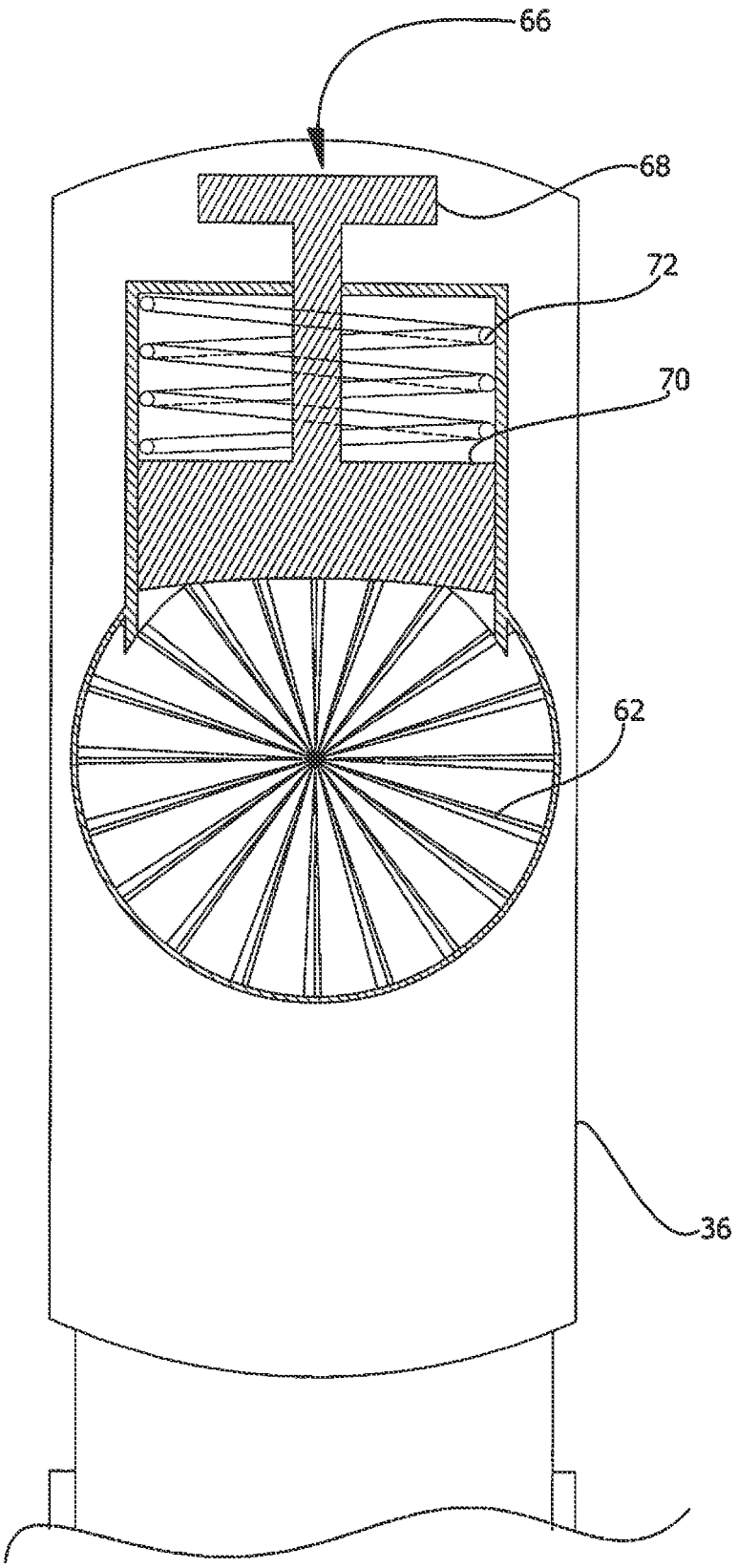
FIG. 4 is a cross-sectional view of an embodiment of the disclosure.
Figure 5:
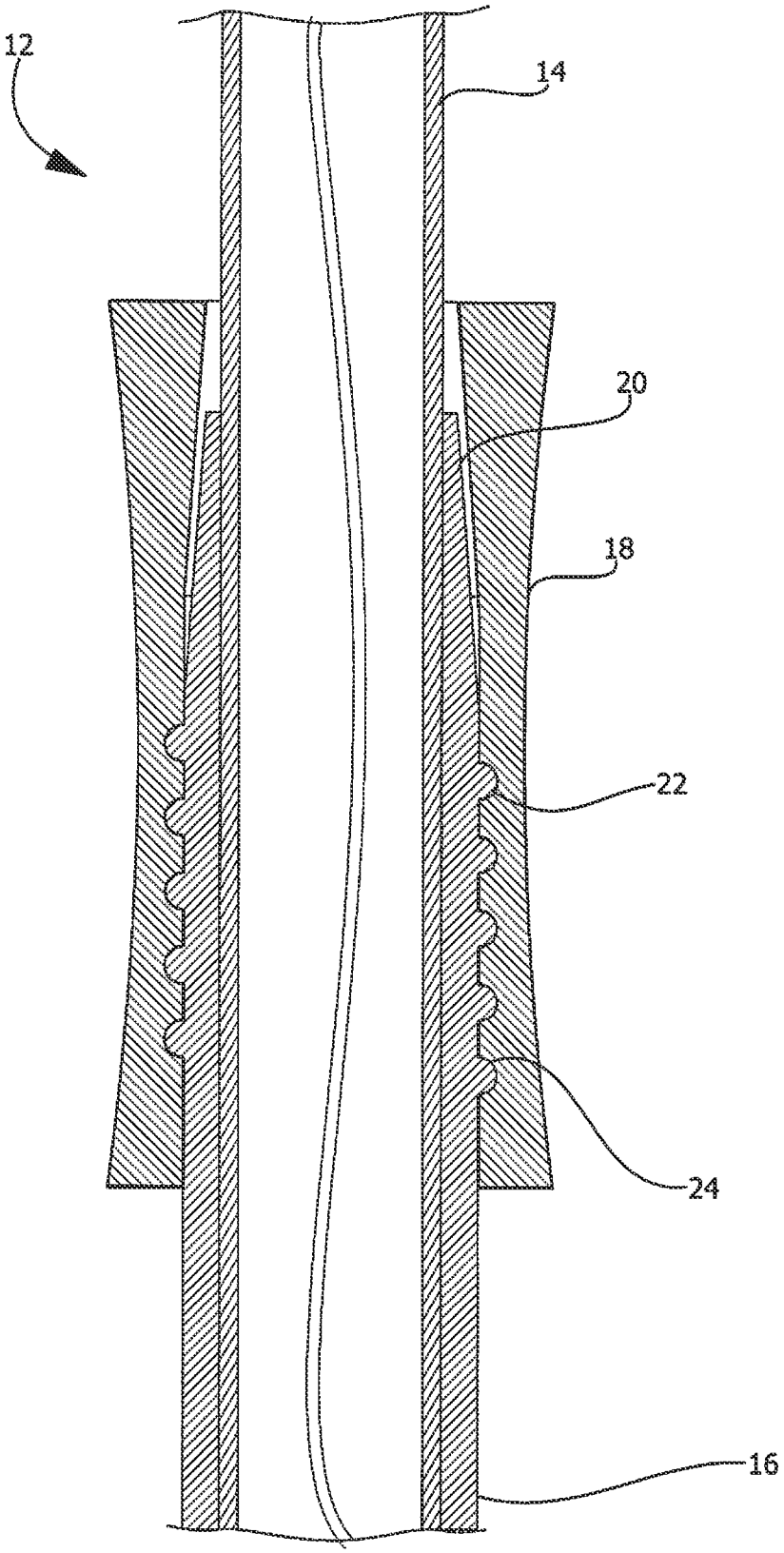
FIG. 5 is a cross-sectional view of an embodiment of the disclosure.
Figure 6:
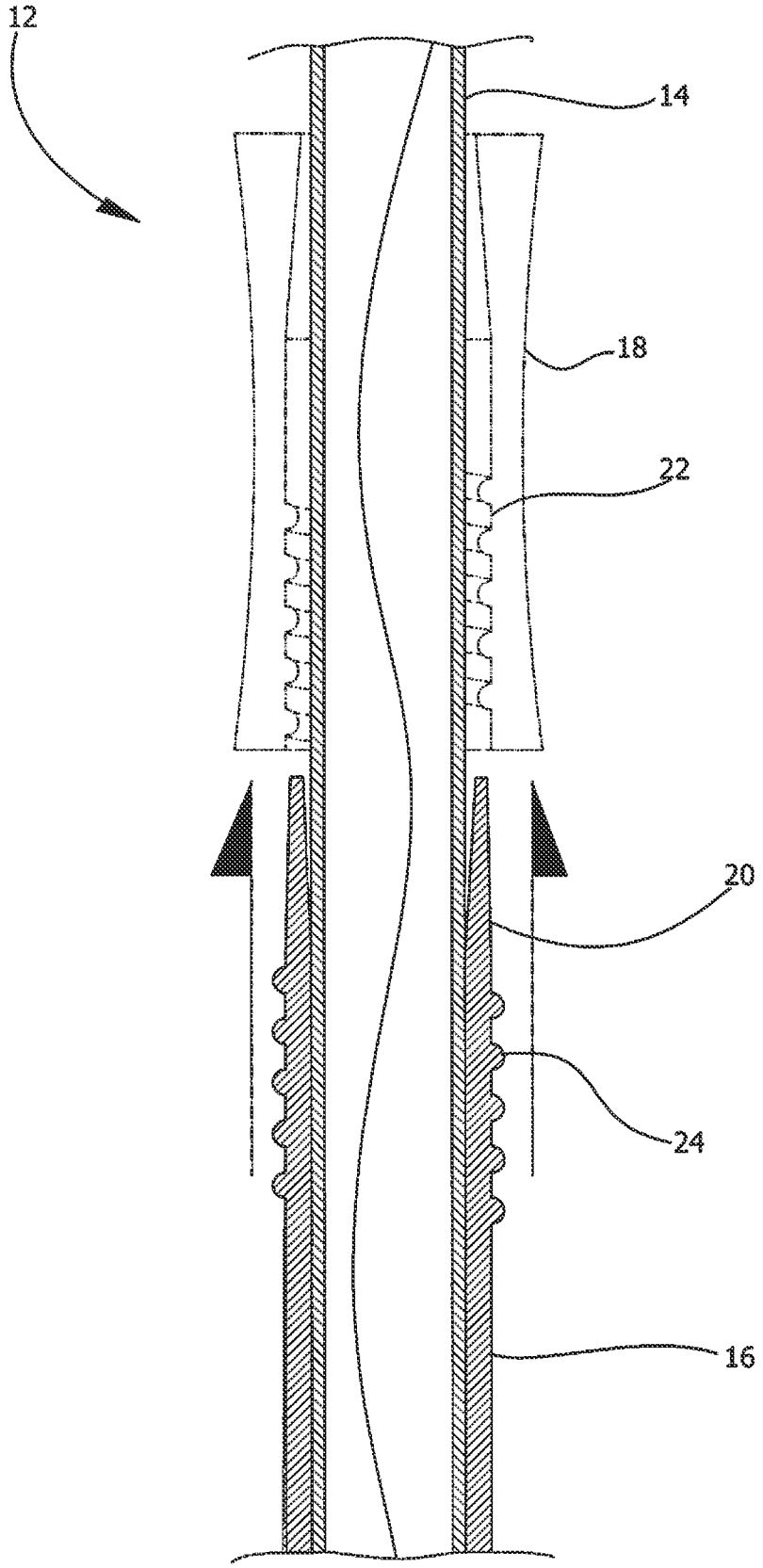
FIG. 6 is a cross-sectional view of an embodiment of the disclosure.
Figure 8:
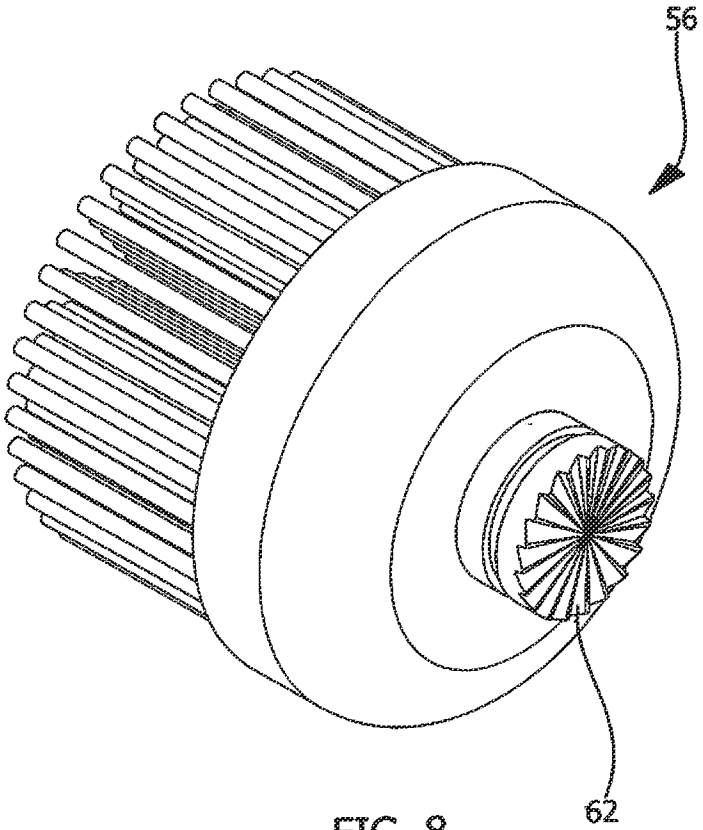
FIG. 8 is an isometric detail view of an embodiment of the disclosure.
Figure 7:
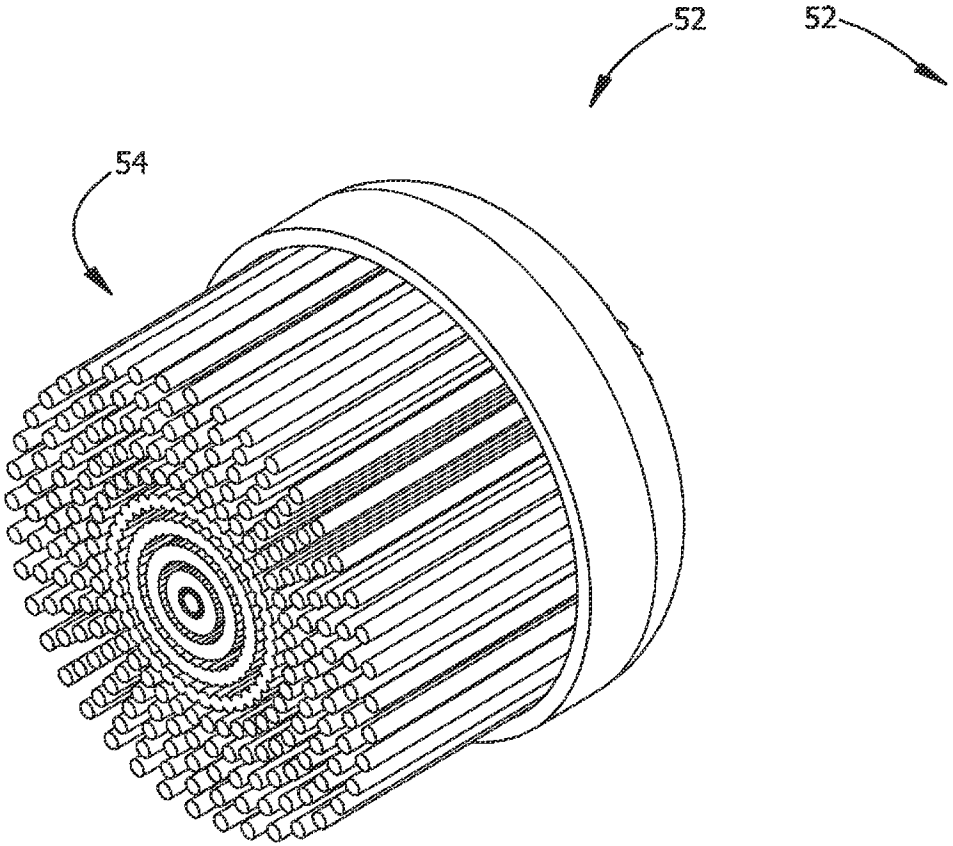
FIG. 7 is an isometric detail view of an embodiment of the disclosure.
Figure 9:
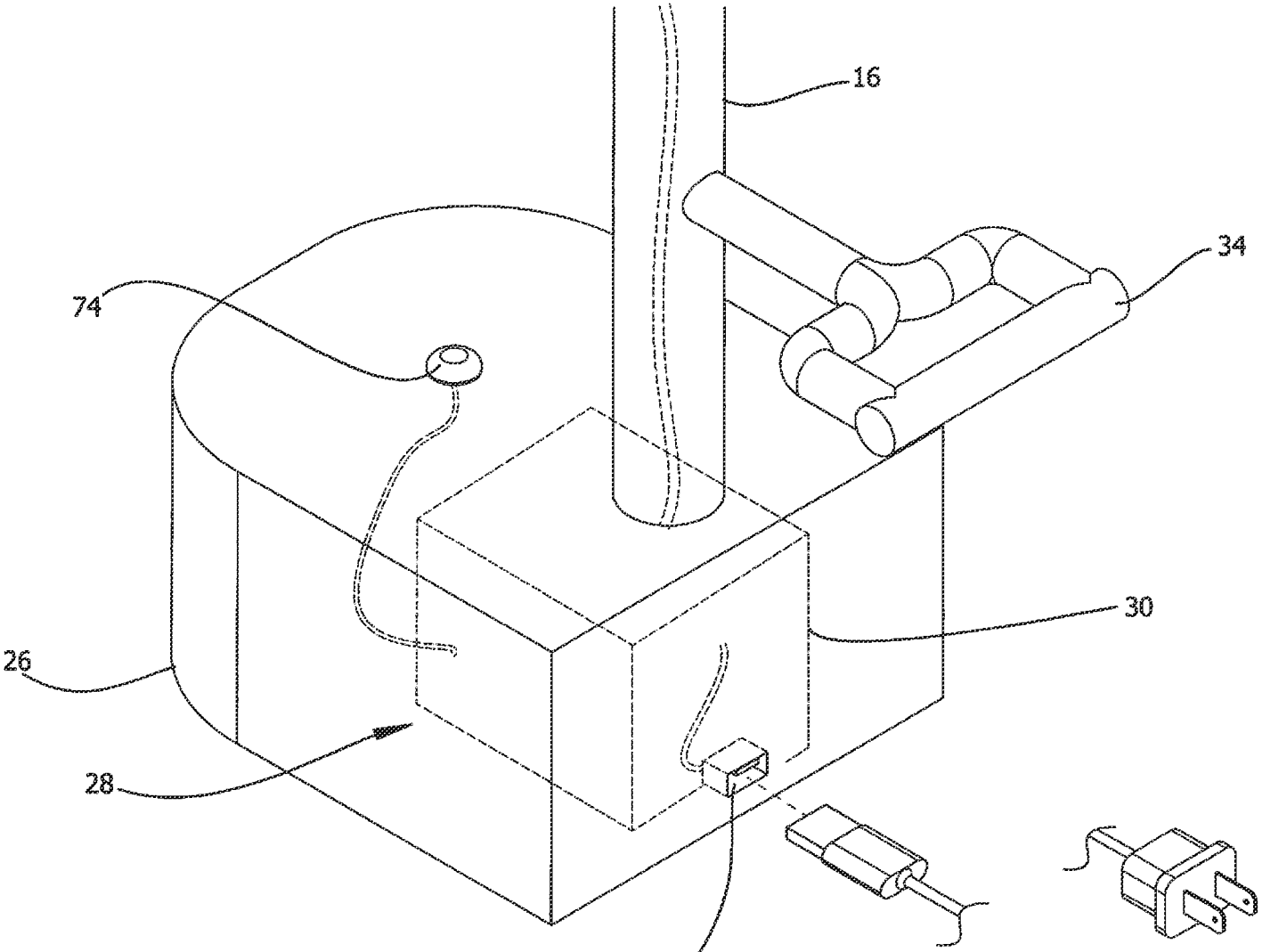
FIG. 9 is a rear isometric detail view of an embodiment of the disclosure.

A motor housing 36 is pivotably attached to the tubular wand 12. For example, the motor housing 36 may be attached to the first shaft 14 opposite the connection between the first shaft 14 and the second shaft 16. The motor housing 36 has a first side 38 and a second side 40. The motor housing 36 is movable between an upwardly angled position 42 and a downwardly angled position 44. As shown in FIG. 2, the second side 40 is positioned facing toward the tubular wand 12 when the motor housing 36 is in the upwardly angled position 42. For example, the second side 40 faces downward, or toward the battery housing 26 when the motor housing 36 is in the upwardly angled position 42. The second side 40 is positioned facing away from the tubular wand 12 when the motor housing 36 is in the downwardly angled position 44. For example, the second side 40 faces upward, or away from the battery housing 26 when the motor housing 36 is in the downwardly angled position 44.

The motor housing 36 has an interior motor space 46. The motor housing 36 is configured to inhibit penetration of water into the interior motor space 46. For example, any openings on the motor housing 36 may be sealed to reduce or inhibit water flowing into the interior motor space 46. The motor housing 36 may be sufficiently sealed to minimize or eliminate the risk of water flowing into the interior motor space 46. The motor housing 36 may be submerged underwater while the pool cleaning device 10 is being used, so the motor housing 36 should be sealed tightly to inhibit water flow.

A motor 48 is positioned in the interior motor space 46. The motor 48 is electronically coupled to the power source 30. In some embodiments, the motor 48 is a rotation motor. An output shaft 50 is rotatably coupled to the motor 48. The output shaft 50 extends outwardly from the motor 48, for example being positioned in the first side 38 of the motor housing 36.

A bristle brush 52 is removably coupled to the motor housing 36. The bristle brush 52 has a front side 54 and a back side 56. The back side 56 is removably attached to the output shaft 50, wherein the motor 48 rotates the output shaft 50, thereby rotating the bristle brush 52. Pivoting the motor housing 36 pivots the bristle brush 52 between the upwardly angled position 42 and the downwardly angled position 44. A plurality of bristles 58 is positioned on the front side 54. Pivoting the motor housing 36 changes the angle of the plurality of bristles 58 against a surface 76, such that the pool cleaning device 10 can scrub walls, angles, and corners of a pool 78.

A coupler 60 releasably secures the bristle brush 52 to the motor housing 36. Because the bristle brush 52 is removable from the motor housing 36, the bristle brush 52 can be exchanged for a new bristle brush, for example one having a different arrangement or configuration of bristles or because the bristle brush has become dirty, worn or broken.

The coupler 60 generally comprises a motor coupling fin 62 positioned on the output shaft 50. A brush coupling fin 64 is positioned on the back side 56 of the bristle brush 52. The brush coupling fin 64 is complementary to the motor coupling fin 62 such that engagement of the motor coupling fin 62 to the brush coupling fin 64 secures the bristle brush 52 to the motor 48.

A release tab 66 is mounted to the motor housing 36. The release tab 66 is positioned on the first side 38, proximate to the motor coupling fin 62. The release tab 66 releasably secures the motor coupling fin 62 to the brush coupling fin 64.

The release tab comprises a pull tab 68 extending upwardly from the motor housing 36. The pull tab 68 is positioned above the output shaft 50. A pressure plate 70 is mounted within the motor housing 36 adjacent to the motor coupling fin 62. The pressure plate 70 is configured to apply a pressure downwardly on the motor coupling fin 62 and the brush coupling fin 64 when the bristle brush 52 is secured to the motor housing 36, thereby securely engaging the motor coupling fin 62 with the brush coupling fin 64. A spring 72 is mounted to the motor housing 36. The spring 72 is tensioned to exert the pressure on the pressure plate 70 such that the motor coupling fin 62 retains physical contact with the brush coupling fin 64.

A power switch 74 may also be positioned on the pool cleaning device 10, for example on the battery housing 26 or the motor housing 36. In other embodiments, the power switch 74 may be positioned on the tubular wand 12. The power switch 74 is actuatable to turn the motor 48 on and off. The power switch 74 may also have other functions, such as adjusting the pivoted position of the motor housing 36 or the speed at which the motor 48 rotates the bristle brush 52.

In use, the pool cleaning device 10 can be used to brush, scrub, or otherwise clean all walls or surfaces 76 of a pool 78. The user can adjust the length of the tubular wand 12 so that the pool cleaning device 10 easily reaches a desired surface 76, regardless of the depth of the surface 76 beneath the water. The battery housing 26 and the motor housing 36 both inhibit water flow to protect the power source 30 and motor 48, respectively, from being damaged by water. The motor 48 rotates the bristle brush 52 so that the bristle brush 52 can move in a circular pattern over the desired surface 76, improving the ability of the pool cleaning device 10 to clean the desired surface 76. The motor housing 36 also pivots upwardly and downwardly, so that the bristle brush 52 can be applied to a curved surface 76 or a corner surface 76. The user can efficiently and comfortably clean the entire pool 78 using the pool cleaning device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A scrubber brush comprising:

a tubular wand comprising:

a first shaft telescopically coupled to a second shaft, the first shaft being nested within the second shaft such that the second shaft is extendable relative to the first shaft;

a battery housing being affixed to the tubular wand, the battery housing having an interior space, the battery housing being configured to inhibit penetration of water into the interior battery space;

a power source being positioned in the interior battery space;

a motor housing being pivotably attached to the tubular wand, the motor housing having a first side and a second side, the motor housing being movable between an upwardly angled position and a downwardly angled position, wherein the second side is positioned facing toward the tubular wand when the motor housing is in the upwardly angled position, and wherein the second side is positioned facing away from the tubular wand when the motor housing is in the downwardly angled position, the motor housing having an interior motor space, the motor housing being configured to inhibit penetration of water into the interior motor space;

a motor being positioned in the interior motor space, the motor being electronically coupled to the power source;

an output shaft extending outwardly from the motor, the output shaft being positioned at the first side of the motor housing;

a bristle brush being coupled to the motor, the bristle brush having a front side and a back side, the back side being attached to the output shaft, wherein the motor rotates the output shaft, thereby rotating the bristle brush, and wherein pivoting the motor housing pivots the bristle brush;

a plurality of bristles being positioned on the front side;

a coupler releasably securing the bristle brush to the motor housing;

the coupler including a motor coupling fin being positioned on the output shaft, a brush coupling fin being positioned on the back side, the brush coupling fin being complementary to the motor coupling fin such that engagement of the motor coupling fin to the brush coupling fin secures the bristle brush to the motor, and a release tab being mounted to the motor housing, the release tab being positioned proximate to the motor coupling fin, the release tab releasably securing the motor coupling fin to the brush coupling fin; and the release tab including a pull tab extending upwardly from the motor housing, the pull tab being positioned above the output shaft, a pressure plate being mounted within the motor housing adjacent to the motor coupling fin, the pressure plate being configured to apply a pressure downwardly on the motor coupling fin and the brush coupling fin when the bristle brush is secured to the motor housing, thereby securely engaging the motor coupling fin with the brush coupling fin, and a spring being mounted to the motor housing, the spring being tensioned to exert the pressure on the pressure plate such that the motor coupling fin retains physical contact with the brush coupling fin.

2. The scrubber brush of claim 1, the tubular wand further comprising:

an adjustment handle being slidably coupled to the first shaft and removably coupled to the second shaft, the adjustment handle sliding along the first shaft when the adjustment handle is removed from the second shaft, the adjustment handle being configured to secure a position of the first shaft relative to the second shaft when the adjustment handle is coupled to the second shaft;

a retaining flange being integrally coupled to the second shaft adjacent to the first shaft, the first shaft being nested within the second shaft adjacent to the retaining flange, the retaining flange being resiliently compressible beneath the adjustment handle, wherein compression of the retaining flange squeezes the retaining flange over the first shaft, thereby restricting movement of the first shaft relative to the second shaft; and the adjustment handle including a handle threading and the compressible retaining flange including a flange threading, the handle threading being complementary to the flange threading such that the adjustment handle is threadably coupled to the second shaft, wherein rotation of the adjustment handle over the second shaft is configured to compress the retaining flange, thereby bracing the first shaft within the second shaft and securing a length of the tubular wand.

3. The scrubber brush of claim 1, wherein the power source is a rechargeable battery.

4. The scrubber brush of claim 3, further comprising a charging port being positioned on the battery housing, the charging port being electronically coupled to the power source.

5. The scrubber brush of claim 1, further comprising a handle being affixed to the second shaft, the handle being adjacent to the battery portion.

6. The scrubber brush of claim 1, wherein the bristle brush is removably coupled to the motor, such that the back side is removably attached to the output shaft.

7. A scrubber brush comprising:

a tubular wand comprising:

a first shaft telescopically coupled to a second shaft, the first shaft being nested within the second shaft such that the second shaft is extendable relative to the first shaft;

an adjustment handle being slidably coupled to the first shaft and removably coupled to the second shaft, the adjustment handle sliding along the first shaft when the adjustment handle is removed from the second shaft, the adjustment handle being configured to secure a position of the first shaft relative to the second shaft when the adjustment handle is coupled to the second shaft;

a retaining flange being integrally coupled to the second shaft adjacent to the first shaft, the first shaft being nested within the second shaft adjacent to the retaining flange, the retaining flange being resiliently compressible beneath the adjustment handle, wherein the adjustment handle compresses the retaining flange, thereby squeezing the retaining flange over the first shaft, and thereby restricting movement of the first shaft relative to the second shaft;

the adjustment handle including a handle threading and the retaining flange including a flange threading, the handle threading being complementary to the flange threading such that the adjustment handle is threadably coupled to the second shaft, wherein rotation of the adjustment handle over the second shaft is configured to compress the retaining flange, thereby bracing the first shaft within the second shaft and securing a length of the tubular wand;

a battery housing being affixed to the second shaft, the battery housing having an interior battery space, the battery housing being configured to inhibit penetration of water into the interior battery space;

a power source being positioned in the interior battery space, the power source being a rechargeable battery;

a charging port being positioned on the battery housing, the charging port being electronically coupled to the power source;

a handle being affixed to the second shaft, the handle being adjacent to the battery housing, the handle being spaced from the adjustment handle;

a motor housing being pivotably attached to the first shaft, the motor housing having a first side and a second side, the motor housing being movable between an upwardly angled position and a downwardly angled position, wherein the second side is positioned facing toward the tubular wand when the motor housing is in the upwardly angled position, and wherein the second side is positioned facing away from the tubular wand when the motor housing is in the downwardly angled position, the motor housing having an interior motor space, the motor housing being configured to inhibit penetration of water into the interior motor space;

a motor being positioned in the interior motor space, the motor being electronically coupled to the power source, the motor being a rotation motor;

an output shaft being rotatably coupled to the motor, the output shaft extending outwardly from the motor, the output shaft being positioned in the first side of the motor housing;

a bristle brush being removably coupled to the motor housing, the bristle brush having a front side and a back side, the back side being removably attached to the output shaft, wherein the motor rotates the output shaft, thereby rotating the bristle brush, and wherein pivoting the motor housing pivots the bristle brush between the upwardly angled position and the downwardly angled position;

a plurality of bristles being positioned on the front side;

a power switch being positioned on the battery housing, the power switch being actuatable to turn the motor on and off;

a coupler releasably securing the bristle brush to the motor housing, the coupler comprising:

a motor coupling fin being positioned on the output shaft;

a brush coupling fin being positioned on the back side, the brush coupling fin being complementary to the motor coupling fin such that engagement of the motor coupling fin to the brush coupling fin secures the bristle brush to the motor;

a release tab being mounted to the motor housing, the release tab being positioned proximate to the motor coupling fin, the release tab releasably securing the motor coupling fin to the brush coupling fin, the release tab comprising:

a pull tab extending upwardly from the motor housing, the pull tab being positioned above the output shaft;

a pressure plate being mounted within the motor housing adjacent to the motor coupling fin, the pressure plate being configured to apply a pressure downwardly on the motor coupling fin and the brush coupling fin when the bristle brush is secured to the motor housing, thereby securely engaging the motor coupling fin with the brush coupling fin; and a spring being mounted to the motor housing, the spring being tensioned to exert the pressure on the pressure plate such that the motor coupling fin retains physical contact with the brush coupling fin.

* * * * *